US010583444B2

(12) United States Patent
Pringle, IV et al.

(10) Patent No.: US 10,583,444 B2
(45) Date of Patent: Mar. 10, 2020

(54) METHODS FOR BEAD APPLICATION

(71) Applicant: The Boeing Company, Chicago, IL (US)

(72) Inventors: John Walter Pringle, IV, Gardena, CA (US); Raul Tomuta, Huntington Beach, CA (US)

(73) Assignee: THE BOEING COMPANY, Chicago, IL (US)

( * ) Notice: Subject to any disclaimer, the term of this patent is extended or adjusted under 35 U.S.C. 154(b) by 248 days.

(21) Appl. No.: 15/812,802

(22) Filed: Nov. 14, 2017

(65) Prior Publication Data

US 2018/0065130 A1 Mar. 8, 2018

Related U.S. Application Data

(62) Division of application No. 14/662,877, filed on Mar. 19, 2015, now Pat. No. 9,884,329.

(51) Int. Cl.
*B05D 1/26* (2006.01)
*B05B 1/02* (2006.01)
(Continued)

(52) U.S. Cl.
CPC ..... *B05B 1/02* (2013.01); *B05C 5/0216* (2013.01); *B05C 17/00516* (2013.01);
(Continued)

(58) Field of Classification Search
CPC ..... B05D 1/26; B05B 1/02; B05C 5/0216; B05C 5/0204; B05C 17/00516; B65D 47/28
See application file for complete search history.

(56) References Cited

U.S. PATENT DOCUMENTS 2,126,999 A 8/1938 Mitchell
2,227,792 A 1/1941 Norton, Jr.
(Continued)

FOREIGN PATENT DOCUMENTS

CN 1528026 A 9/2004
CN 1829572 A 9/2006
(Continued)

OTHER PUBLICATIONS

"Notification of Reasons for Rejection" dated Jun. 4, 2019, Summarized Translation and Japanese-language provided.
(Continued)

*Primary Examiner* — Nathan H Empie
(74) *Attorney, Agent, or Firm* — MH2 Technology Law Group LLP

(57) ABSTRACT

A method of applying a substance as a bead to a geometric feature, extending along a path, comprises providing an apparatus, comprising an outlet end that comprises a first edge, a second edge, and an outlet opening. The method also comprises establishing contact between at least a portion of the geometric feature and at least a portion of at least one of the first edge of the outlet end and the second edge of the outlet end. The method further comprises moving the apparatus in a progression direction along the path while dispensing the substance from the outlet opening on at least the portion of the geometric feature. The method additionally comprises varying a length of a portion of the first edge of the outlet end and a length of a portion of the second edge of the outlet end.

20 Claims, 16 Drawing Sheets

(51) Int. Cl.
*B05C 17/005* (2006.01)
*B05C 5/02* (2006.01)
*B65D 47/28* (2006.01)

(52) U.S. Cl.
CPC ..... *B05D 1/26* (2013.01); *B05C 5/0204* (2013.01); *B65D 47/28* (2013.01)

(56) References Cited

U.S. PATENT DOCUMENTS

| | | | |
|---|---|---|---|
| 2,609,974 | A | 9/1952 | Brous |
| 2,824,443 | A | 2/1958 | Ames |
| 3,661,679 | A | 5/1972 | Law |
| 3,746,253 | A | 7/1973 | Walberg |
| 3,888,421 | A | 6/1975 | Chow |
| 3,933,187 | A | 1/1976 | Marlinski |
| 4,104,983 | A | 8/1978 | Carstedt |
| 4,135,476 | A | 1/1979 | Duryea |
| 4,570,834 | A | 2/1986 | Ward |
| 4,698,005 | A | 10/1987 | Kikuchi et al. |
| 4,925,081 | A | 5/1990 | Jeromson, Jr. et al. |
| 4,932,094 | A | 6/1990 | McCowin |
| 4,948,016 | A | 8/1990 | Summons et al. |
| 4,989,792 | A | 2/1991 | Claasen |
| 5,017,113 | A | 5/1991 | Heaton et al. |
| 5,271,521 | A | 12/1993 | Noss et al. |
| 5,271,537 | A | 12/1993 | Johnson |
| 5,292,368 | A | 3/1994 | Komine et al. |
| 5,319,568 | A | 6/1994 | Bezaire |
| 5,346,380 | A | 9/1994 | Ables |
| 5,462,199 | A | 10/1995 | Lenhardt |
| 5,480,487 | A | 1/1996 | Figini et al. |
| 5,571,538 | A | 11/1996 | Cloud |
| 5,615,804 | A | 4/1997 | Brown |
| 5,647,111 | A | 7/1997 | Zienkiewicz et al. |
| 5,733,597 | A | 3/1998 | Schmitkons et al. |
| 5,803,367 | A | 9/1998 | Heard et al. |
| 5,906,298 | A | 5/1999 | Martindale et al. |
| 5,920,974 | A | 7/1999 | Bullen |
| 5,976,631 | A | 11/1999 | Ramachandran |
| 5,992,686 | A | 11/1999 | Cline et al. |
| 5,995,909 | A | 11/1999 | Bretmersky et al. |
| 6,001,181 | A | 12/1999 | Bullen |
| 6,082,587 | A | 7/2000 | Martindale et al. |
| 6,213,354 | B1 | 4/2001 | Kay |
| 6,698,617 | B1 | 3/2004 | Szymanski |
| 6,730,168 | B1 | 5/2004 | Ross |
| 6,739,483 | B2 | 5/2004 | White et al. |
| 6,935,541 | B1 | 8/2005 | Campbell et al. |
| 6,942,736 | B2 | 9/2005 | Chinander et al. |
| 6,986,472 | B2 | 1/2006 | Gordon |
| 7,090,155 | B1 | 8/2006 | Rabitsch |
| 7,172,096 | B2 | 2/2007 | O'Dougherty |
| 7,275,663 | B2 | 10/2007 | Campbell et al. |
| 7,578,416 | B2 | 8/2009 | Underwood |
| 7,592,033 | B2 | 9/2009 | Buckley et al. |
| 7,815,132 | B2 | 10/2010 | Baltz |
| 7,922,107 | B2 | 4/2011 | Fox |
| 8,181,822 | B2 | 5/2012 | Doehman et al. |
| 8,251,262 | B2 | 8/2012 | Peckels |
| 8,453,876 | B2 | 6/2013 | Miller |
| 8,534,499 | B2 | 9/2013 | Williams et al. |
| 8,562,888 | B2 | 10/2013 | Kelley et al. |
| 8,651,046 | B1 | 2/2014 | Davancens et al. |
| 9,095,872 | B2 | 8/2015 | Topf et al. |
| 9,149,829 | B2 | 10/2015 | Gill |
| 2004/0170756 | A1 | 9/2004 | Machida |
| 2005/0145724 | A1 | 7/2005 | Blette et al. |
| 2009/0108033 | A1 | 4/2009 | Quinn et al. |
| 2010/0260531 | A1 | 10/2010 | Rademacher |
| 2011/0297175 | A1 | 12/2011 | Pires et al. |
| 2012/0273115 | A1 | 11/2012 | Suzuki et al. |
| 2014/0294480 | A1 | 10/2014 | Gill |
| 2015/0044376 | A1 | 2/2015 | Topf et al. |
| 2015/0053787 | A1 | 2/2015 | Tomuta et al. |
| 2015/0217326 | A1 | 8/2015 | Nawata et al. |

FOREIGN PATENT DOCUMENTS

| | | | |
|---|---|---|---|
| CN | 202021120 | U | 11/2011 |
| CN | 101858456 | B | 12/2012 |
| DE | 102004027789 | A1 | 2/2005 |
| DE | 202005005619 | U1 | 2/2006 |
| DE | 102004042211 | A1 | 3/2006 |
| DE | 102008010169 | A1 | 9/2009 |
| DE | 202007019244 | U1 | 8/2011 |
| DE | 102010030375 | A1 | 12/2011 |
| EP | 0181483 | A1 | 5/1986 |
| EP | 1245348 | A1 | 3/2002 |
| EP | 1425107 | B1 | 5/2006 |
| EP | 2277631 | A1 | 1/2011 |
| FR | 2508350 | A1 | 12/1982 |
| GB | 2282554 | A | 4/1995 |
| GB | 2481299 | A | 12/2011 |
| JP | H03-109673 | U | 11/1991 |
| JP | H09 38556 | A | 2/1997 |
| JP | 2002059049 | | 2/2002 |
| JP | 2012-152699 | A | 8/2012 |
| JP | 2014-054606 | A | 3/2014 |
| JP | 2014-057638 | A | 4/2014 |
| WO | WO0067915 | | 11/2000 |
| WO | WO2002068163 | A1 | 9/2002 |
| WO | WO2005012845 | A2 | 2/2005 |
| WO | WO2010093494 | A1 | 8/2010 |
| WO | WO2011108358 | A2 | 9/2011 |
| WO | WO2013112178 | A1 | 8/2013 |
| WO | WO2014042236 | A1 | 3/2014 |

OTHER PUBLICATIONS

First Notification of Office Action dated Dec. 29, 2018 from corresponding Chinese Application No. 201610140053.2.

International Search Report and Written Opinion, dated Oct. 7, 2014, regarding PCT Application No. PCT/US2014/040989, 10 pages.

Extended European Search Report, dated Oct. 15, 2014, regarding Application No. 14175644.5, 6 pages.

International Search Report and Written Opinion, dated Oct. 15, 2014, regarding PCT Application No. PCT/US2014/045018, 8 pages.

Office Action, dated Oct. 1, 2014, regarding U.S. Appl. No. 13/886,535, 17 pages.

Notice of Allowance, dated Dec. 19, 2014, regarding U.S. Appl. No. 13/886,535, 13 pages.

Office Action, dated Nov. 28, 2014, regarding U.S. Appl. No. 13/951,817, 17 pages.

International Search Report and Written Opinion, dated Jun. 4, 2014, regarding PCT Application No. PCT/US2014/011879, 9 pages.

International Search Report and Written Opinion, dated Jun. 4, 2014, regarding PCT Application No. PCT/US2014/0033738, 9 pages.

Tomuta et al., "Fluid Application Device," U.S. Appl. No. 14/016,846, filed Sep. 3, 2013, 59 pages.

Davancens et al., "Robotic Sealant and end Effector," U.S. Appl. No. 12/842,247, filed Jul. 23, 2010, 41 page.

Tomuta et al., "Fluid Application Device," U.S. Appl. No. 13/769,569, filed Feb. 18, 2013, 63 pages.

Topf et al., "Control Valve Having a Disposable Valve Body," U.S. Appl. No. 13/886,535, filed May 3, 2013, 52 pages.

"Dispense Valves for Adhesives, Sealants, Lubricants, Epoxy, Polyurethan, Silicone & More," Kiss, No-Drip, Snuf-Bak, Tip-Seal, Manual, Metering, and High Flow Valve part specifications, Sealant Equipment and Engineering, Inc., 12 pages, accessed Apr. 9, 2013 (http://www.sealantequipment.com/dispensevalves-1part.htm).

"No-Drip Air Operated Fluid Dispense Valve," 2100-108 Series part specifications, Sealant Equipment and Engineering, Inc., 2 pages, accessed Apr. 9, 2013 (http://www.sealantequipment.com/pdf/DispenseValves/2100-108%20No-Drip%20Valves.pdf).

"Compliance Nozzle," 1208-178-000 part specifications, Sealant Equipment and Engineering, Inc., 2 pages, accessed Apr. 9, 2013 (http://sealantequipment.com/pdf/DispenseValves/1208-178%20Compliance%20Nozzle.pdf).

(56) References Cited

OTHER PUBLICATIONS

Topf et al., "Feedback Control System for Performing Fluid Dispensing Operations," U.S. Appl. No. 13/951,817, filed Jul. 25, 2013, 51 pages.
Extended European Search Report dated Jan. 8, 2015, regarding Application No. 14180160.5-1760, 6 pages.
European Office Action dated Jan. 11, 2018 in related corresponding European Application No. 16160903.7.

METHODS FOR BEAD APPLICATION

CROSS-REFERENCE TO RELATED APPLICATIONS

This application is a divisional of U.S. patent application Ser. No. 14/662,877, filed on Mar. 19, 2015, the entirety of which is incorporated by reference herein.

BACKGROUND

Applying beads of a fluent material, such as sealant, to structural and non-structural joints and seams having non-constant geometry is conventionally a manual process, which is time consuming and tedious for the operator. The bead shapes may have to meet exacting specifications requiring curved or domed formations of a particular thickness or radius, concave fillets, and transitions between such formations and fillets. Manually shaping the bead over non-constant geometry while incorporating the aforementioned features complicates the sealant application process, creates potential for rework and associated costs, and increases manufacturing lead time.

SUMMARY

Accordingly, apparatuses and methods, intended to address at least the above-identified concerns, would find utility.

The following is a non-exhaustive list of examples, which may or may not be claimed, of the subject matter according the present disclosure.

One example of the present disclosure relates to an apparatus for applying a substance as a bead to a geometric feature extending along a path. The apparatus comprises an outlet end comprising a first edge, a second edge, and an outlet opening at least partially defined by the first edge and the second edge. The first edge and the second edge are reversibly extensible.

Another example of the present disclosure relates to a method of applying a substance as a bead to a geometric feature extending along a path, where the geometric feature includes a dimension A that has a variation along a path. The method 300 comprises providing an apparatus comprising an outlet end comprising a first edge, a second edge, and an outlet opening at least partially defined by the first edge and the second edge. The first edge comprises a portion B, a portion C, and a portion D between the portion B and the portion C, wherein the portion D has a length L. The second edge comprises a portion B', a portion C', and a portion D' between the portion B' and the portion C'. The portion D' has a length L'. The method further comprises establishing contact between at least a portion of the geometric feature and at least a portion of at least one of the first edge of the outlet end of the apparatus and the second edge of the outlet end of the apparatus. Method 300 further comprises, responsive to moving the apparatus in a progression direction along the path while dispensing the substance from the outlet opening on at least the portion of the geometric feature, varying the length L of the portion D of the first edge of the outlet end and the length L' of the portion D' of the second edge of the outlet end in direct proportion to the variation of the dimension A of the geometric feature along the path.

BRIEF DESCRIPTION OF THE DRAWINGS

Having thus described examples of the present disclosure in general terms, reference will now be made to the accompanying drawings, which are not necessarily drawn to scale, and wherein like reference characters designate the same or similar parts throughout the several views, and wherein:

FIG. 1 is a block diagram of an apparatus for applying a substance as a bead to a geometric feature, according to one or more examples of the present disclosure;

FIG. 2 is a schematic, perspective, environmental view of the applicator of FIG. 1, according to one or more examples of the present disclosure;

FIG. 3 is a schematic perspective view of the apparatus of FIG. 1, according to one or more examples of the present disclosure;

FIG. 4 is a schematic perspective view of the apparatus of FIG. 1, according to one or more examples of the present disclosure;

FIG. 5 is a schematic, environmental, cross-sectional view of an exemplary bead produced by the apparatus of FIG. 1, according to one or more examples of the present disclosure;

FIG. 6 is a schematic perspective view of the apparatus of FIG. 1, according to one or more examples of the present disclosure;

FIG. 7 is a schematic perspective view of a portion of the apparatus of FIG. 1, according to one or more examples of the present disclosure;

FIG. 8 is a schematic perspective view of the apparatus of FIG. 1, according to one or more examples of the present disclosure;

FIG. 9A is a schematic side elevational detail view of a first side of the apparatus of FIG. 1, according to one or more examples of the present disclosure;

FIG. 9B is a schematic side elevational detail view of an opposed second side of the apparatus of FIG. 9A, the view taken from the direction of the first side, according to one or more examples of the present disclosure;

FIG. 10 is a schematic perspective view of the apparatus of FIG. 1, according to one or more examples of the present disclosure;

Figure 1:
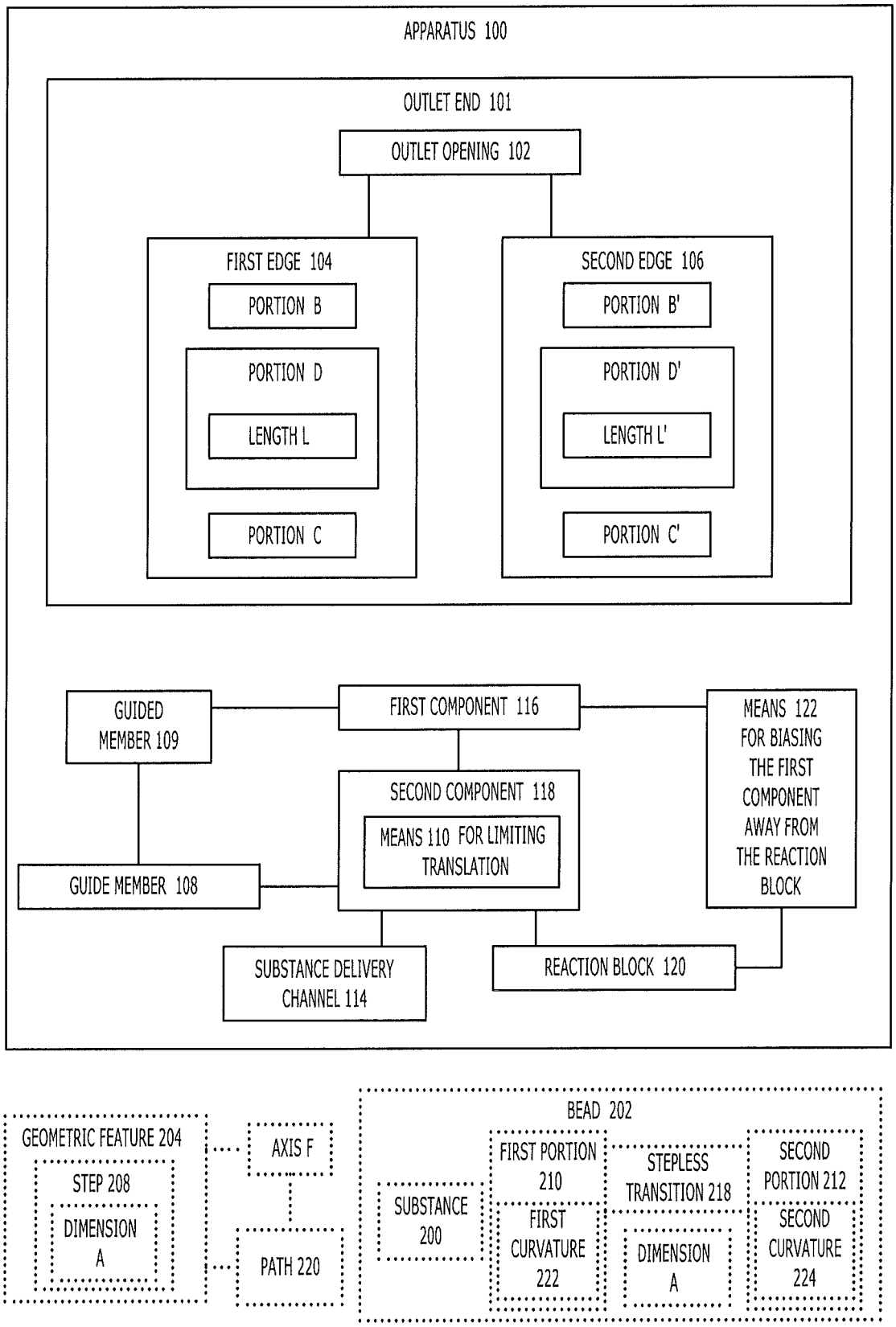
Figure 11A:
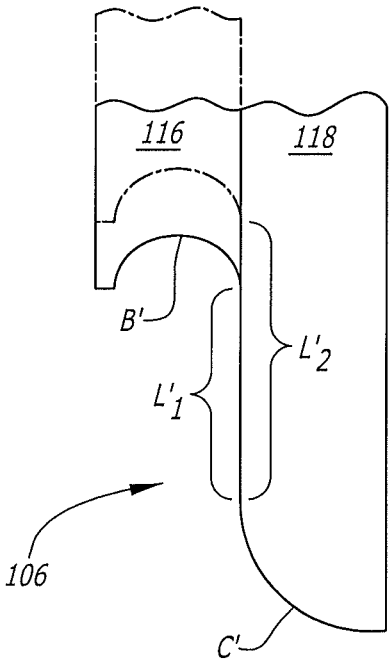
Figure 11B:
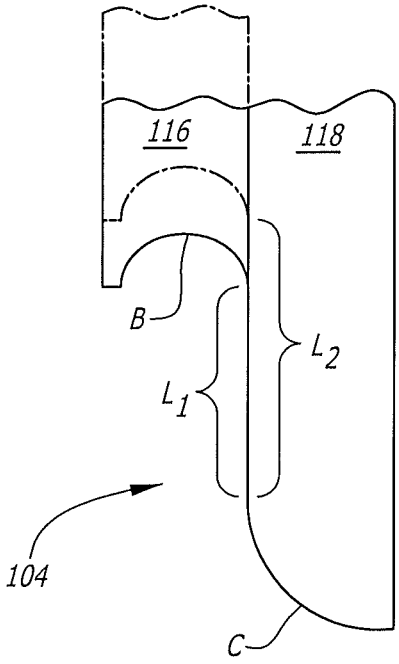
Figure 12A:
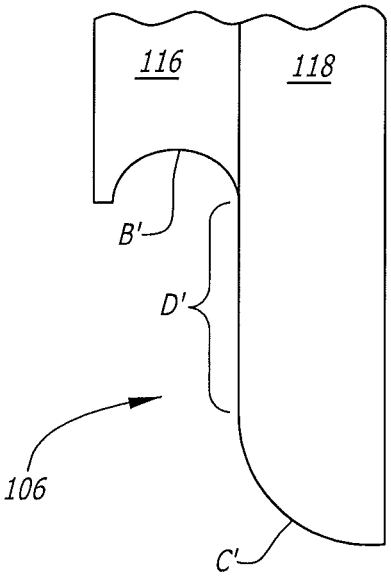
Figure 12B:
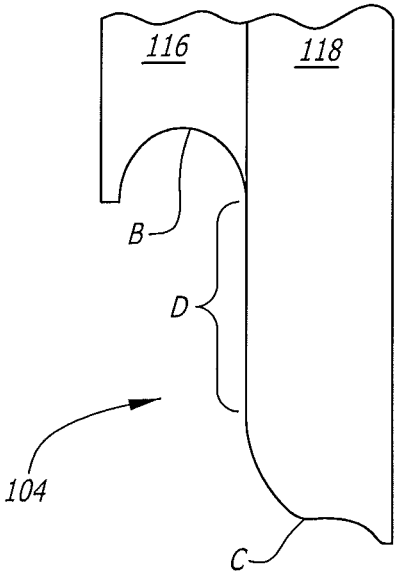
Figure 13A:
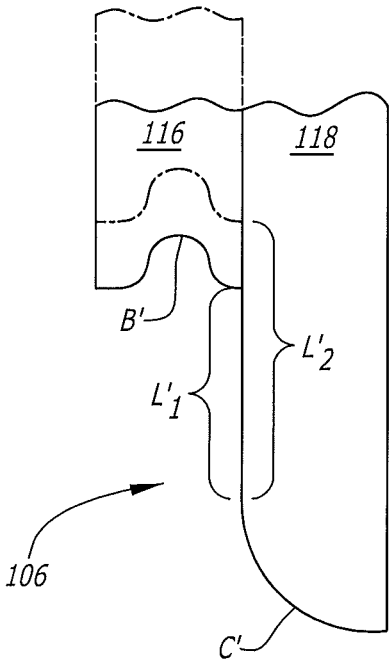
Figure 13B:
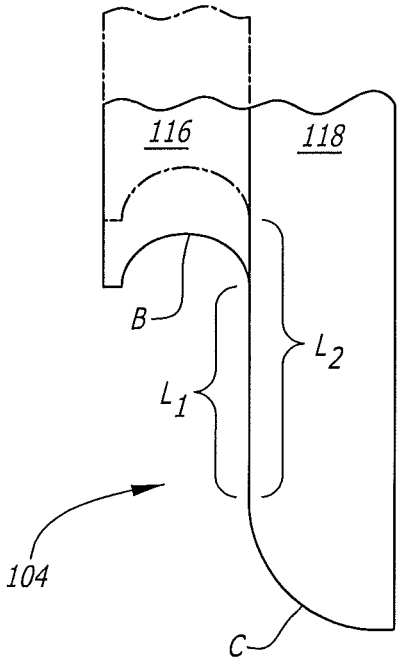
Figure 14A:
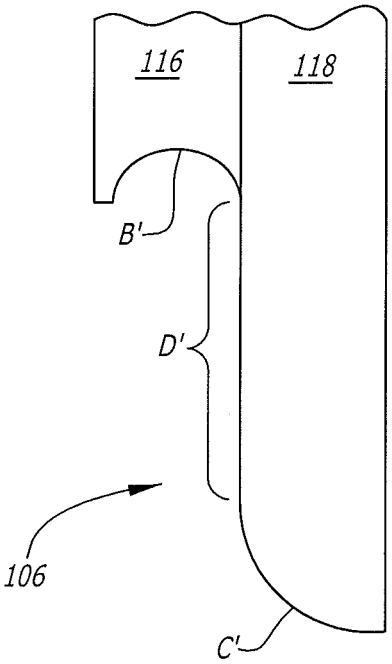
Figure 14B:
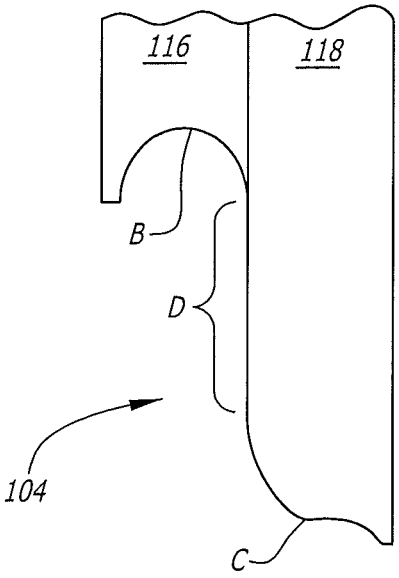
Figure 15A:
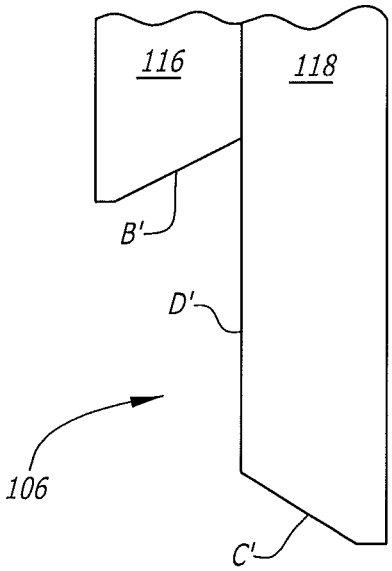
Figure 15B:
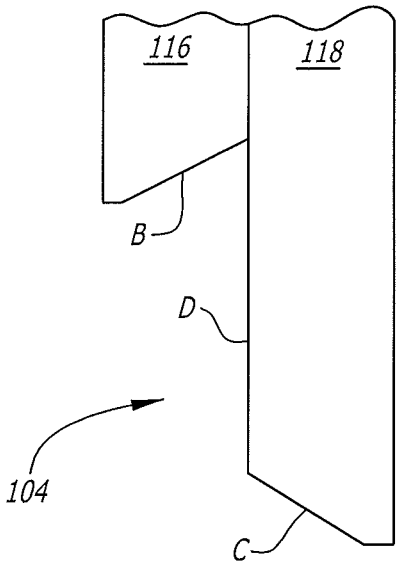
Figure 16A:
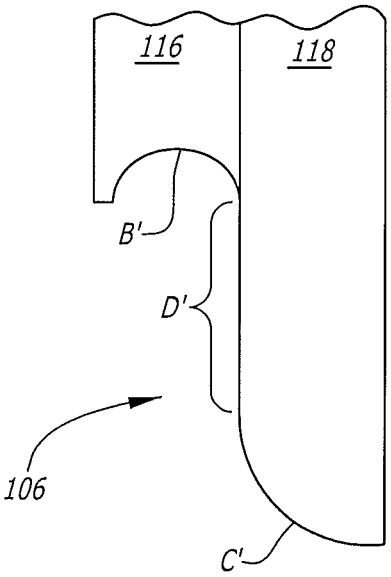
Figure 16B:
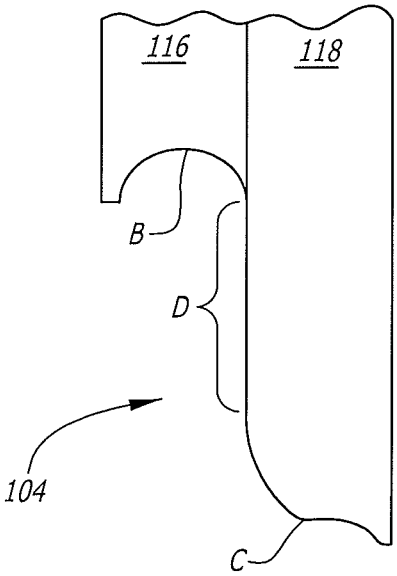
Figure 17:
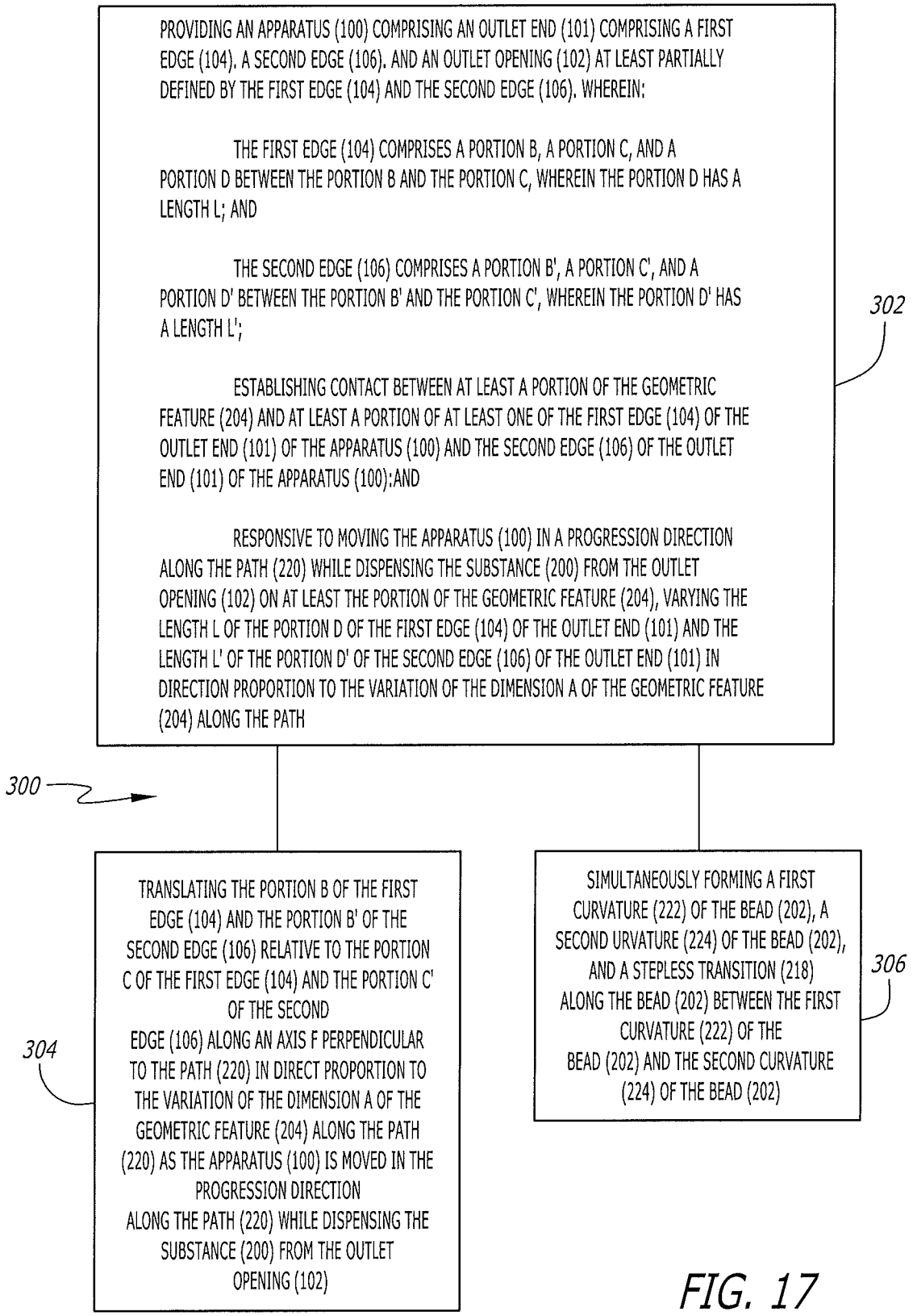
Figure 18:
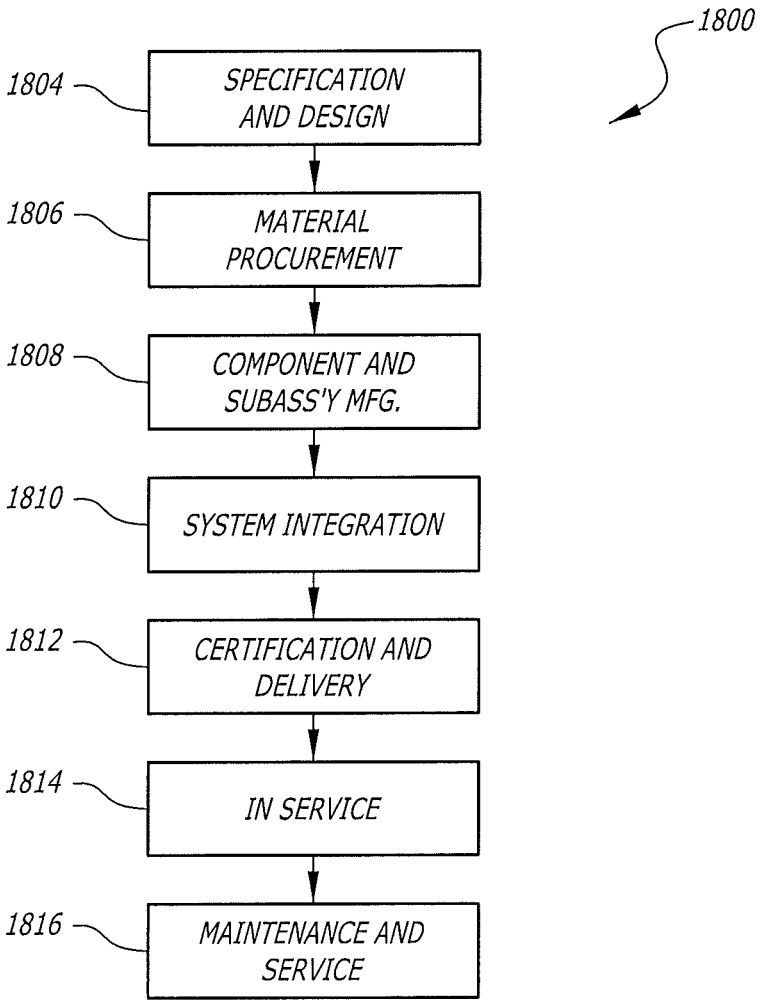
Figure 19:
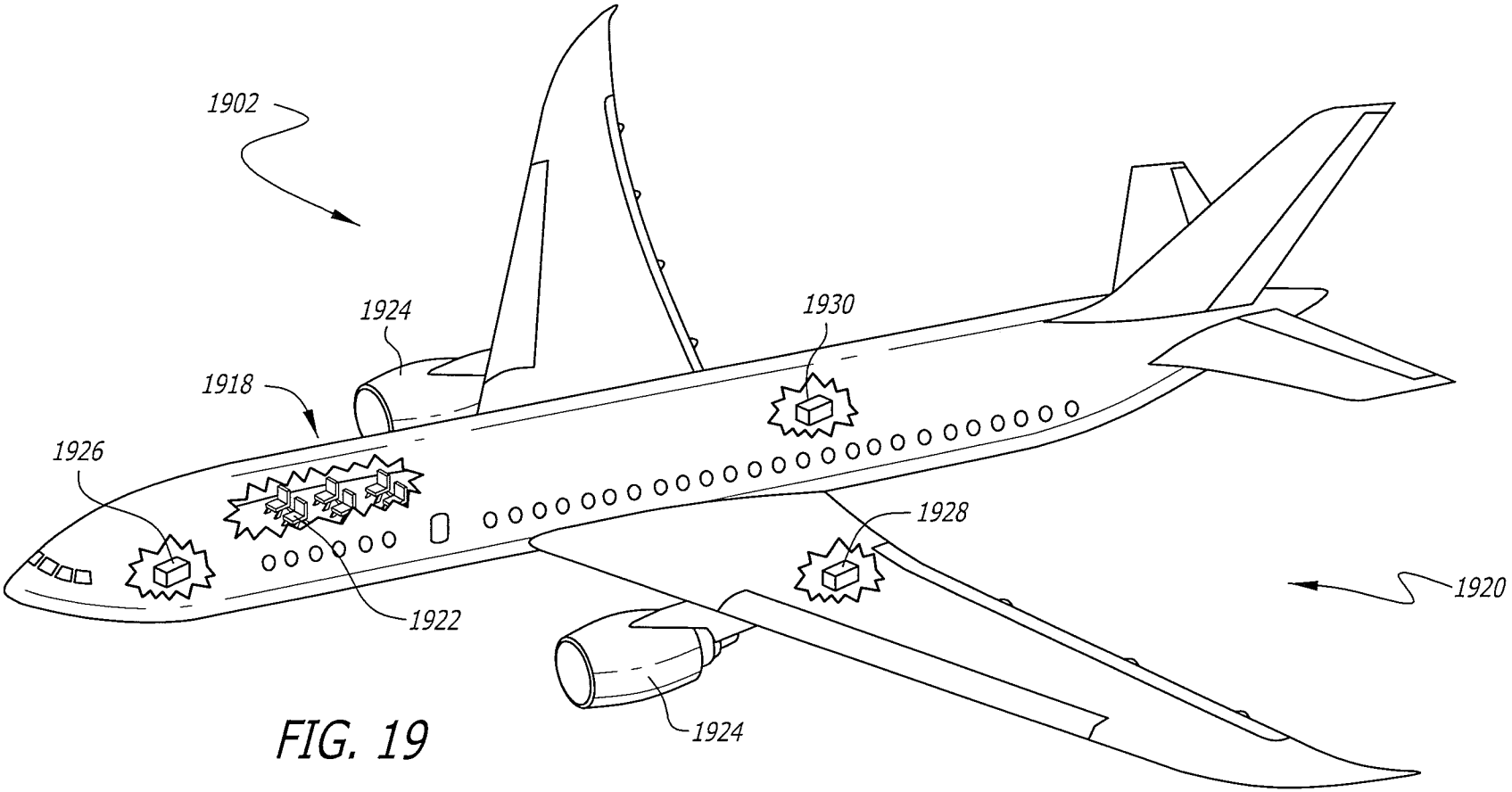

FIG. 11A is a schematic side elevational detail view of a first side of the apparatus of FIG. 1, according to one or more examples of the present disclosure;

FIG. 11B is a schematic side elevational detail view of an opposed second side of the apparatus of FIG. 11A, the view taken from the direction of the first side, according to one or more examples of the present disclosure;

FIG. 12A is a schematic side elevational detail view of a first side of the apparatus of FIG. 1, according to one or more examples of the present disclosure;

FIG. 12B is a schematic side elevational detail view of an opposed second side of the apparatus of FIG. 12A, the view taken from the direction of the first side, according to one or more examples of the present disclosure;

FIG. 13A is a schematic side elevational detail view of a first side of the apparatus of FIG. 1, according to one or more examples of the present disclosure;

FIG. 13B is a schematic side elevational detail view of an opposed second side of the apparatus of FIG. 13A, the view taken from the direction of the first side, according to one or more examples of the present disclosure;

FIG. 14A is a schematic side elevational detail view of a first side of the apparatus of FIG. 1, according to one or more examples of the present disclosure;

FIG. 14B is a schematic side elevational detail view of an opposed second side of the apparatus of FIG. 14A, the view taken from the direction of the first side, according to one or more examples of the present disclosure;

FIG. 15A is a schematic side elevational detail view of a first side of the apparatus of FIG. 1, according to one or more examples of the present disclosure;

FIG. 15B is a schematic side elevational detail view of an opposed second side of the apparatus of FIG. 15A, the view taken from the direction of the first side, according to one or more examples of the present disclosure;

FIG. 16A is a schematic side elevational detail view of a first side of the apparatus of FIG. 1, according to one or more examples of the present disclosure;

FIG. 16B is a schematic side elevational detail view of an opposed second side of the apparatus of FIG. 16A, the view taken from the direction of the first side, according to one or more examples of the present disclosure;

FIG. 17 is a block diagram of a method of applying a substance as a bead to a geometric feature extending along a path, according to one or more examples of the present disclosure;

FIG. 18 is a block diagram of aircraft production and service methodology; and FIG. 19 is a schematic illustration of an aircraft.

DETAILED DESCRIPTION

In FIG. 1, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIG. lmay be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

In FIGS. 18 and 19, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 18 and 19 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Reference herein to "one example" means that one or more feature, structure, or characteristic described in connection with the example is included in at least one implementation. The phrase "one example" in various places in the specification may or may not be referring to the same example.

Illustrative, non-exhaustive examples, which may or may not be claimed, of the subject matter according the present disclosure are provided below.

Figure 2:
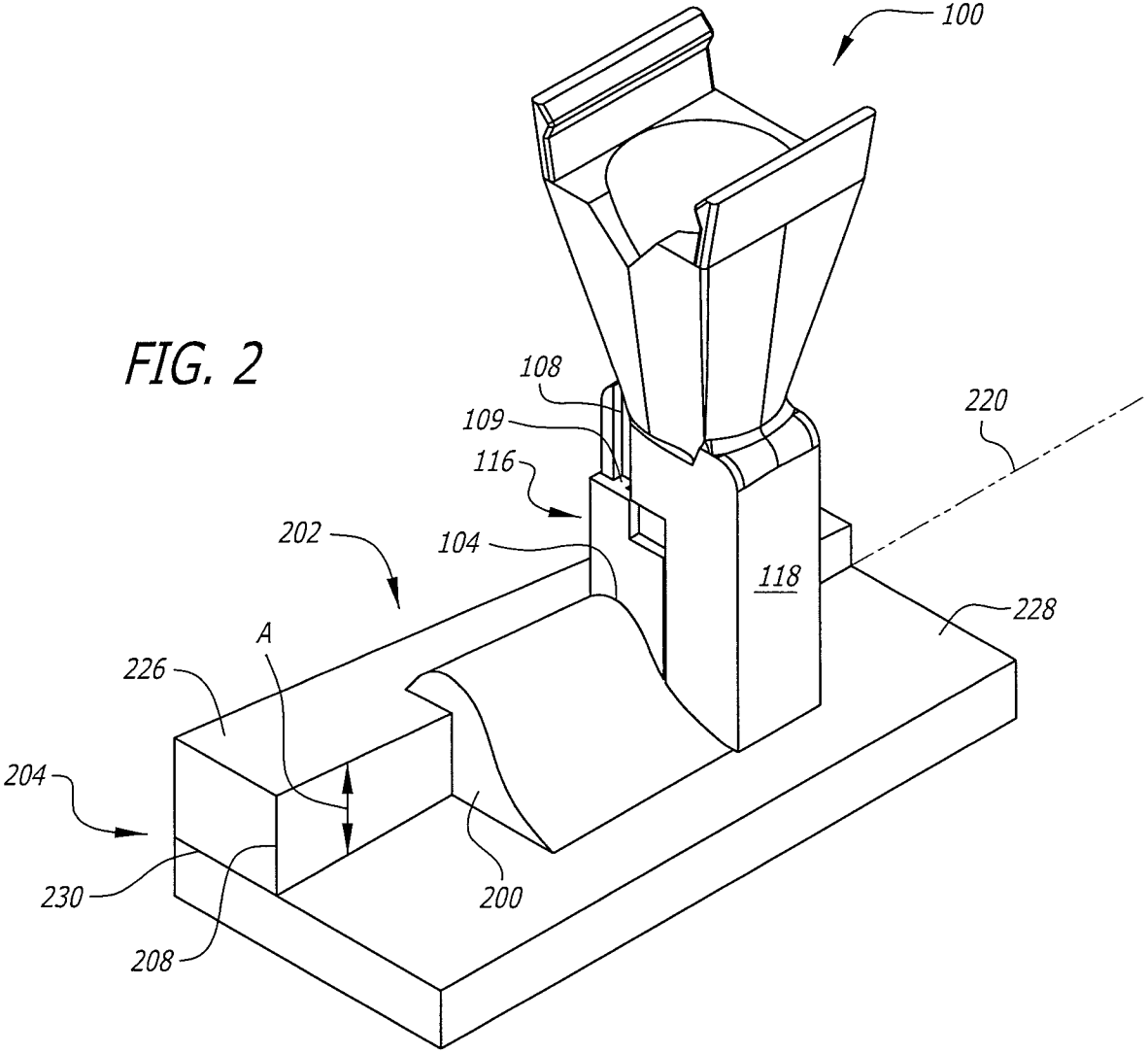

Referring to FIGS. 1-8, and 10, and particularly to e.g. FIG. 2, apparatus 100 for applying substance 200 as bead 202 to geometric feature 204 extending along path 220 is disclosed. Apparatus 100 comprises outlet end 101 comprising first edge 104, second edge 106, and outlet opening 102 at least partially defined by first edge 104 and second edge 106. First edge 104 and second edge 106 are reversibly extensible. The preceding subject matter of this paragraph is in accordance with example 1 of the present disclosure.

First edge 104 has a characteristic profile which imparts a particular shape to bead 202. The shape may assure that bead 202 meet production specifications which may apply to geometric feature 204. As will be discussed hereinafter, reversible extensible nature of first edge 104 enables adjustment of the shape of bead 202, to conform to variation of that surface of geometric feature 204 receiving bead 202, while still meeting specifications. Specifications may for example require a particular thickness of bead 202. As will be discussed hereinafter, as an alternative to first edge 104, second edge 106 may be used to impart a shape or profile to bead 202.

First edge 104 is that portion of outlet opening 102 which determines a profile of bead 202, should apparatus 100 be moved in a progression direction, e.g. to the right, as shown in FIG. 2. When apparatus 100 is used, substance 200 (FIG. 5) is injected into apparatus 100, flows onto geometric feature 204, and remains in place on geometric feature 204 even as apparatus 100 moves in the progression direction. As a trailing edge (i.e., first edge 104 in the example of FIG. 2) passes over dispensed substance 200, the latter is shaped to an intended final profile (e.g., that shown in FIG. 5).

Apparatus 100 may be used as part of or with a manual tool or dispenser of substance 200, or alternatively, as part of a robotic tool or dispenser (neither tool is shown).

In the example of FIG. 2, geometric feature 204 is a substrate on which bead 202 is to be applied. In the course of manufacturing and assembly operations, the substrate may be formed by placing first layer 226 over second layer 228. Bead 202 may be required, for example, to seal a seam or gap at joint 230 between first layer 226 and second layer 228. First and second layers 226, 228 may be aluminum or composite, for example. Geometric feature 204, taken in its entirety, may be a fuel tank of aircraft 1902 (FIG. 19), for example. Where part of a fuel tank, first and second layers 226 and 228 are typically coated with a primer paint.

Substance 200 may be for example a sealant such as PR-1776, a Class C, low weight, fuel tank sealant commercially available from PRC-DeSoto International, Inc., 12780 San Fernando Road, Sylmar, Calif. 91342.

Where first layer 226 and second layer 228 have different footprints, step 208 may be defined in geometric feature 204. Bead 202 must cover enough of first layer 226 and second layer 228 to provide patches of contact enabling adhesive engagement by bead 202 of first and second layers 226, 228 to remain engaged and to seal joint 230.

Figure 5:
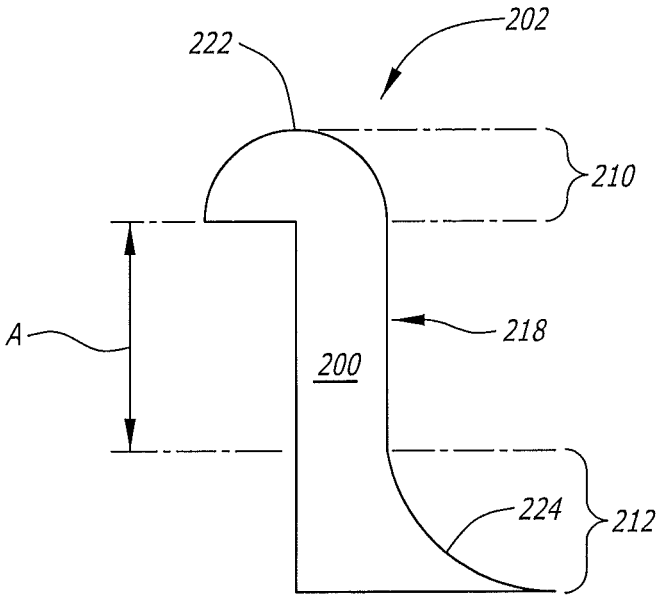

FIG. 2 further reveals that thickness of first layer 226 may vary along its length (length is that dimension extending from left to right in FIG. 2). Thickness of first layer 226 is indicated as dimension A. The same dimension A is reflected in bead 202 (FIG. 5). As apparatus 100 is moved along path 220, substance 200 forming bead 202 is dispensed onto a portion of geometric feature 204. The reversible extensible nature of first edge 104 enables adjustment of the shape of bead 202, to enable bead 202 to vary in direct proportion to variation of dimension A in geometric feature 204.

Figure 3:
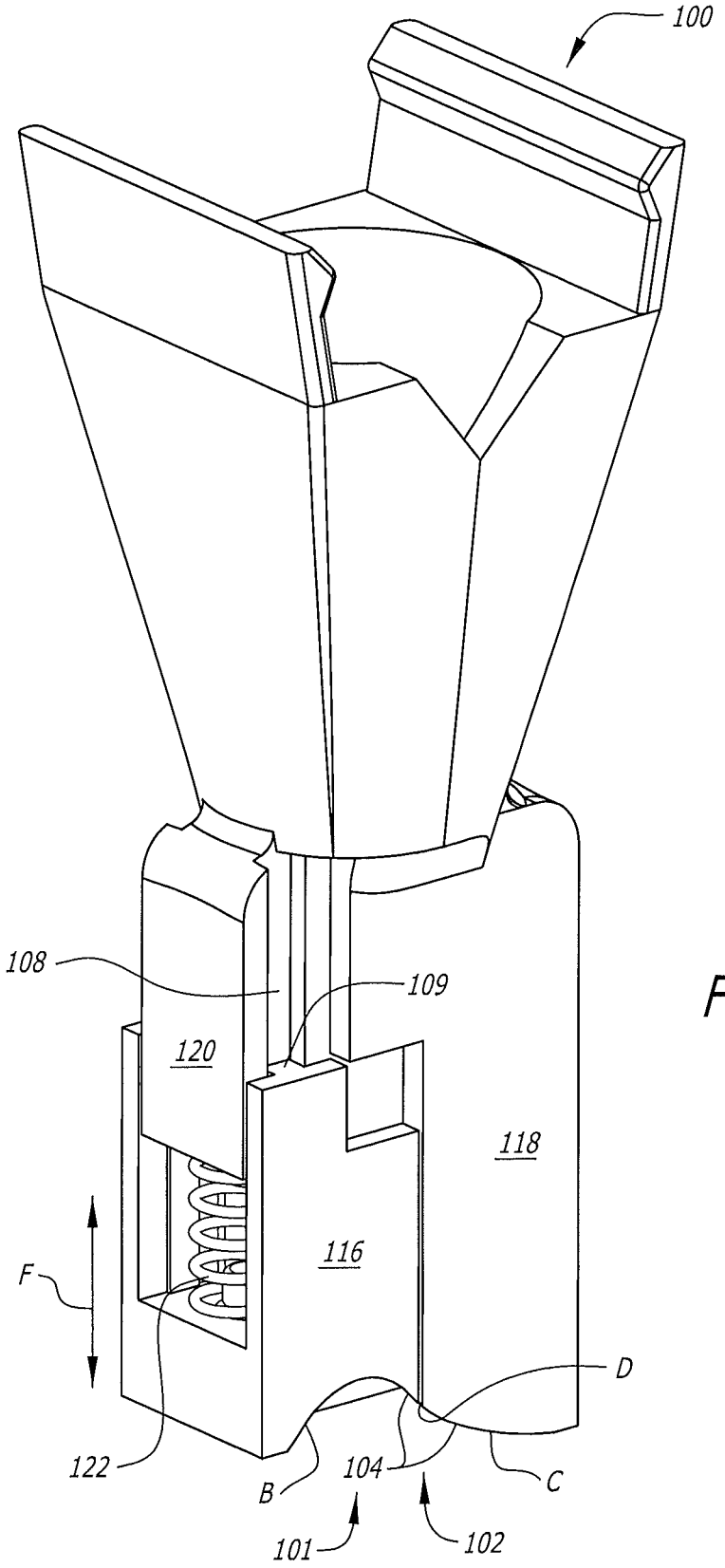

Referring particularly to e.g. FIGS. 3, 11A, and 11B, first and second edges 104, 106 are reversibly extensible in that as respective portions D and D' reflect displacement of first component 116 of apparatus 100 relative to second component 118, magnitude of portions D, D' change. When first component 116 moves upwardly to positions shown in broken lines, as shown in FIGS. 11A, 11B, first and second edges 104, 106 extend, or increase in overall length. Because first component 116 can return to the initial position shown in solid lines, extension is reversible.

Path 220 may be straight, as illustrated in FIG. 2, or alternatively, may be other than straight. Illustratively, path 220 could be curved, could incorporate straight segments, or could include any combination of these.

Figure 9A:
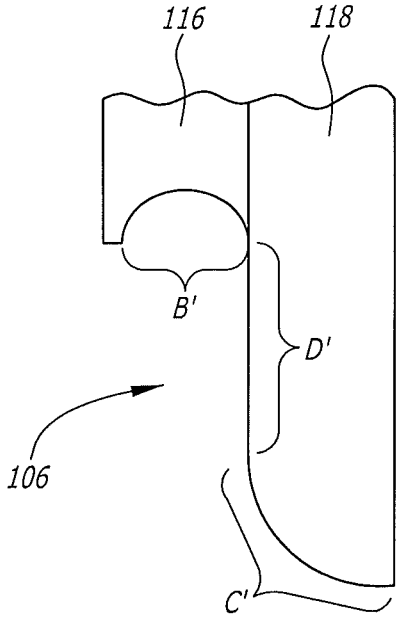
Figure 9B:
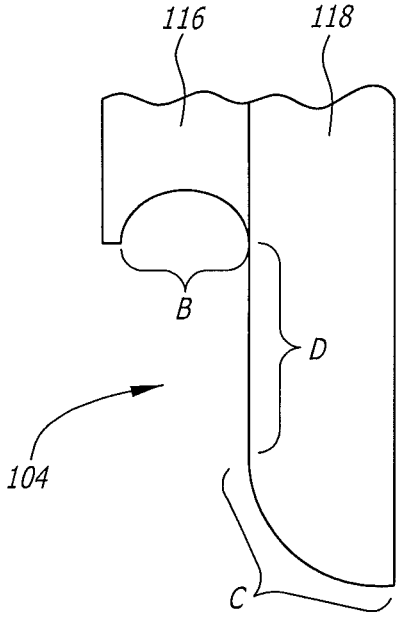
Figure 10:
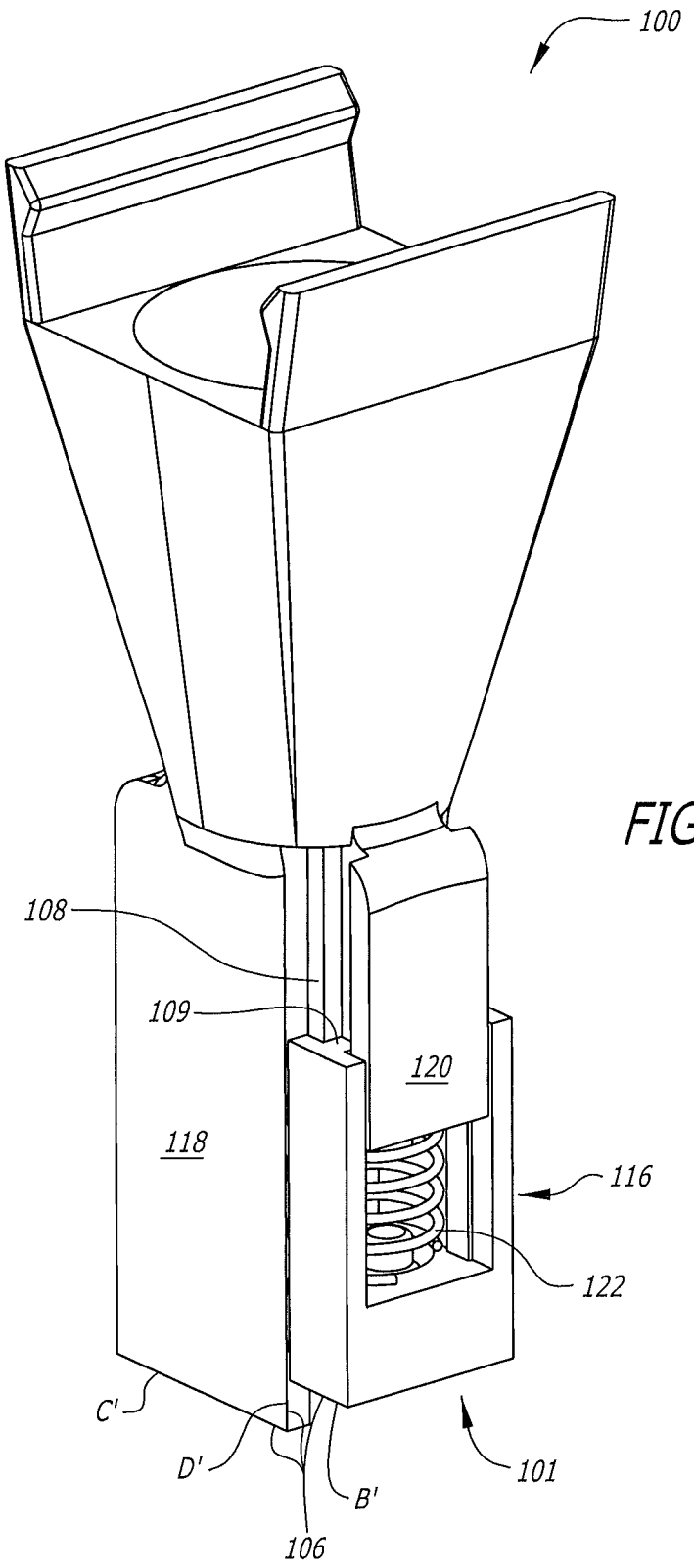

Referring additionally to FIGS. 9A-16B, and particularly to e.g. FIGS. 9A and 9B, first edge 104 of outlet end 101 of apparatus 100 comprises portion B, portion C, and portion D between portion B and portion C. Second edge 106 of outlet end 101 comprises portion B', portion C', and portion D' between portion B' and portion C'. Portion B of first edge 104 of outlet end 101 is movable relative to portion C of first edge 104. Portion B' of second edge 106 of outlet end 101 is movable relative to portion C' of second edge 106. The preceding subject matter of this paragraph is in accordance with example 2 of the present disclosure, and example 2 includes the subject matter of example 1, above.

Turning momentarily to FIG. 5, moving portions B of first edge 104 and B' of second edge 106 enables variation in dimension A of bead 202, thereby causing bead 202 to maintain a specified thickness over geometric feature 204 despite variations in dimension A.

Referring generally to FIG. 1 and more particularly to e.g. FIGS. 3, 6, 9B, 11B, 12B, 13B, 14B, and 16B, portion B of first edge 104 of outlet end 101 of apparatus 100 is non-linear. The preceding subject matter of this paragraph is in accordance with example 3 of the present disclosure, and example 3 includes the subject matter of example 2, above.

When first edge 104 is non-linear, the corresponding portion of bead 202 will be non-linear. As seen in FIG. 5, the corresponding portion of bead 202 conforms to features of geometric feature 204.

Continuing to refer generally to FIG. 1 and more particularly to e.g. FIGS. 3, 6, 9B, 11B, 12B, 13B, 14B, and 16B, portion B of first edge 104 of outlet end 101 of apparatus 100 is curved. The preceding subject matter of this paragraph is in accordance with example 4 of the present disclosure, and example 4 includes the subject matter of example 3, above.

Where portion B is curved, the corresponding portion of bead 202 may be domed, which enables bead 202 to cover the upper surface of first layer 226 uniformly, in that thickness of bead 202 is maintained constant, even at the corner of first layer 226.

Still referring generally to FIG. 1 and particularly to e.g. FIG. 15B, portion B of first edge 104 of outlet end 101 of apparatus 100 is linear. The preceding subject matter of this paragraph is in accordance with example 5 of the present disclosure, and example 5 includes the subject matter of example 2, above.

Where portion B is linear, a corresponding portion of bead 202 will be linear.

Continuing to refer generally to FIG. 1 and more particularly to e.g. FIGS. 3, 6, 9B, 11B, 12B, 13B, 14B, and 16B, portion C of first edge 104 of outlet end 101 of apparatus 100 is non-linear. The preceding subject matter of this paragraph is in accordance with example 6 of the present disclosure, and example 6 includes the subject matter of any of examples 2-5, above.

Where portion C of first edge 104 is non-linear, a corresponding non-linear shape is formed in bead 202.

Continuing to refer generally to FIG. 1 and more particularly to e.g. FIGS. 3, 6, 9B, 11B, 12B, 13B, 14B, and 16B, portion C of first edge 104 of outlet end 101 of apparatus 100 is curved. The preceding subject matter of this paragraph is in accordance with example 7 of the present disclosure, and example 7 includes the subject matter of example 6, above.

A corresponding curvature, such as curvature 224 in FIG. 5, will be formed in bead 202. A fillet making progressive transition from bead 202 to second layer 228 of geometric feature 204 is thus enabled.

Referring generally to FIG. 1 and particularly to e.g. FIG. 15B, portion C of first edge 104 of outlet end of apparatus 100 is linear. The preceding subject matter of this paragraph is in accordance with example 8 of the present disclosure, and example 8 includes the subject matter of any of examples 2-5, above.

Where portion C is linear, a corresponding portion of bead 202 will be linear.

Referring generally to FIG. 1 and particularly to e.g. FIGS. 4, 8, 9A, 10, 11A, 12A, 13A, 14A, and 16A, portion B' of second edge 106 of outlet end 101 of apparatus 100 is non-linear. The preceding subject matter of this paragraph is in accordance with example 9 of the present disclosure, and example 9 includes the subject matter of any of examples 2-8, above.

Where portion B' of second edge 106 is non-linear, a corresponding non-linear shape is formed in bead 202 when the progression direction is opposite that which would result in bead 202 being dispensed from first edge 104.

Still referring generally to FIG. 1 and particularly to e.g. FIGS. 4, 8, 9A, 10, 11A, 12A, 13A, 14A, and 16A, portion B' of second edge 106 of outlet end 101 of apparatus 100 is curved. The preceding subject matter of this paragraph is in accordance with example 10 of the present disclosure, and example 10 includes the subject matter of example 9, above.

Where portion B' of second edge 106 is curved, a corresponding curved shape is formed in bead 202 when the progression direction is opposite that which would result in bead 202 being dispensed from first edge 104. In a specific example, fillet 212 (FIG. 2) may be provided.

Referring generally to FIG. 1 and particularly to e.g. FIG. 15A, portion B' of second edge 106 of outlet end 101 of apparatus 100 is linear. The preceding subject matter of this paragraph is in accordance with example 11 of the present disclosure, and example 11 includes the subject matter of any of examples 2-8, above.

Where portion B' of second edge 106 is linear, a corresponding linear shape is formed in bead 202 when the progression direction is opposite that which would result in bead 202 being dispensed from first edge 104.

Referring generally to FIG. 1 and particularly to e.g. FIGS. 4, 8, 9A, 10, 11A, 12A, 13A, 14A, and 16A, portion C' of second edge 106 of outlet end 101 of apparatus 100 is non-linear. The preceding subject matter of this paragraph is in accordance with example 12 of the present disclosure, and example 12 includes the subject matter of any of examples 2-11, above.

Where portion C' of second edge 106 is non-linear, a corresponding non-linear shape is formed in bead 202 when the progression direction is opposite that which would result in bead 202 being dispensed from first edge 104.

Continuing to refer generally to FIG. 1 and particularly to e.g. FIGS. 4, 8, 9A, 10, 11A, 12A, 13A, 14A, and 16A, portion C' of second edge 106 of outlet end 101 of apparatus 100 is curved. The preceding subject matter of this paragraph is in accordance with example 13 of the present disclosure, and example 13 includes the subject matter of example 12, above.

A corresponding curvature, such as curvature 224 in FIG. 5, will be formed in bead 202. A fillet making progressive transition from bead 202 to second layer 228 of geometric feature 204 is thus enabled when the progression direction is opposite that which would result in bead 202 being dispensed from first edge 104.

Referring generally to FIG. 1 and particularly to e.g. FIG. 15A, portion C' of second edge 106 of outlet end 101 of apparatus 100 is linear. The preceding subject matter of this paragraph is in accordance with example 14 of the present disclosure, and example 14 includes the subject matter of any of examples 2-11, above.

Where portion C' of second edge 106 is linear, a corresponding linear shape is formed in bead 202 when the progression direction is opposite that which would result in bead 202 being dispensed from first edge 104.

Referring generally to FIG. 1 and particularly to e.g. FIGS. 3, 6, 9B, 11B, 12B, 13B, 14B, 15B, and 16B, portion B and portion C of first edge 104 of outlet end 101 of apparatus 100 are constant in length. The preceding subject matter of this paragraph is in accordance with example 15 of the present disclosure, and example 15 includes the subject matter of any of examples 2-14, above.

When portions B and C are constant in length, length of first edge 104 can be varied by translating first component 116 relative to second component 118, thereby selectively revealing or covering a side wall of second component 118.

Still referring generally to FIG. 1 and particularly to e.g. FIGS. 4, 8, 9A, 10, 11A, 12A, 13A, 14A, 15A, and 16A, portion B' and portion C' of second edge 106 of outlet end 101 of apparatus 100 are constant in length. The preceding subject matter of this paragraph is in accordance with example 16 of the present disclosure, and example 16 includes the subject matter of any of examples 2-15, above.

When portions B' and C' are constant in length, length of second edge 106 can be adjusted by varied by translating first component 116 relative to second component 118, thereby selectively revealing or covering a side wall of second component 118.

Referring generally to FIG. 1 and particularly to e.g. FIGS. 3, 6, 9B, 11B, 12B, 13B, 14B, 15B, and 16B, portion B of first edge 104 of outlet end 101 of apparatus 100 is invariable in shape. The preceding subject matter of this paragraph is in accordance with example 17 of the present disclosure, and example 17 includes the subject matter of any of examples 2-16, above.

This may be achieved by fabricating first component 116 from a rigid material such as acrylonitrile butadiene styrene (ABS) plastic. Apparatus 100 will therefore produce a consistent, predictable profile in a corresponding location of bead 202, and may be used to consistently meet a particular specification.

Referring generally to FIG. 1 and particularly to e.g. FIGS. 3, 6, 9B, 11B, 12B, 13B, 14B, 15B, and 16B, portion C of first edge 104 of outlet end 101 of apparatus 100 is invariable in shape. The preceding subject matter of this paragraph is in accordance with example 18 of the present disclosure, and example 18 includes the subject matter of any of examples 2-17, above.

This may be achieved by fabricating second component 118 from a rigid material such as acrylonitrile butadiene styrene (ABS) plastic. Apparatus 100 will therefore produce a consistent, predictable profile in a corresponding location of bead 202, and may be used to consistently meet a particular specification.

Referring generally to FIG. 1 and particularly to e.g. FIGS. 4, 8, 9A, 10, 11A, 12A, 13A, 14A, 15A, and 16A, portion B' of second edge 106 of outlet end 101 of apparatus 100 is invariable in shape. The preceding subject matter of this paragraph is in accordance with example 19 of the present disclosure, and example 19 includes the subject matter of any of examples 2-18, above.

Apparatus 100 will therefore produce a consistent, predictable profile in a corresponding location of bead 202, and may be used to consistently meet a particular specification.

Referring generally to FIG. 1 and particularly to e.g. FIGS. 4, 8, 9A, 10, 11A, 12A, 13A, 14A, 15A, and 16A, portion C' of second edge 106 of outlet end 101 of apparatus 100 is invariable in shape. The preceding subject matter of this paragraph is in accordance with example 20 of the present disclosure, and example 20 includes the subject matter of any of examples 2-19, above.

Apparatus 100 will therefore produce a consistent, predictable profile in a corresponding location of bead 202 when the progression direction is opposite that which would result in bead 202 being dispensed from first edge 104, and may be used to consistently meet a particular specification.

Referring generally to FIG. 1 and particularly to e.g. FIGS. 2-4 and 6-16B, at least one of portion B and portion C of first edge 104 of outlet end 101 of apparatus 100 are curved or portion B' and portion C' of second edge 106 of outlet end 101 of apparatus 100 are curved. At least one of first edge 104 or second edge 106 is contoured to provide stepless transition 218 along bead 202 between first curvature 222 of bead 202 and second curvature 224 of bead 202. The preceding subject matter of this paragraph is in accordance with example 21 of the present disclosure, and example 21 includes the subject matter of example 2, above.

A stepless transition may avoid generating sharp edges, which may assist in meeting product specifications.

Figure 6:
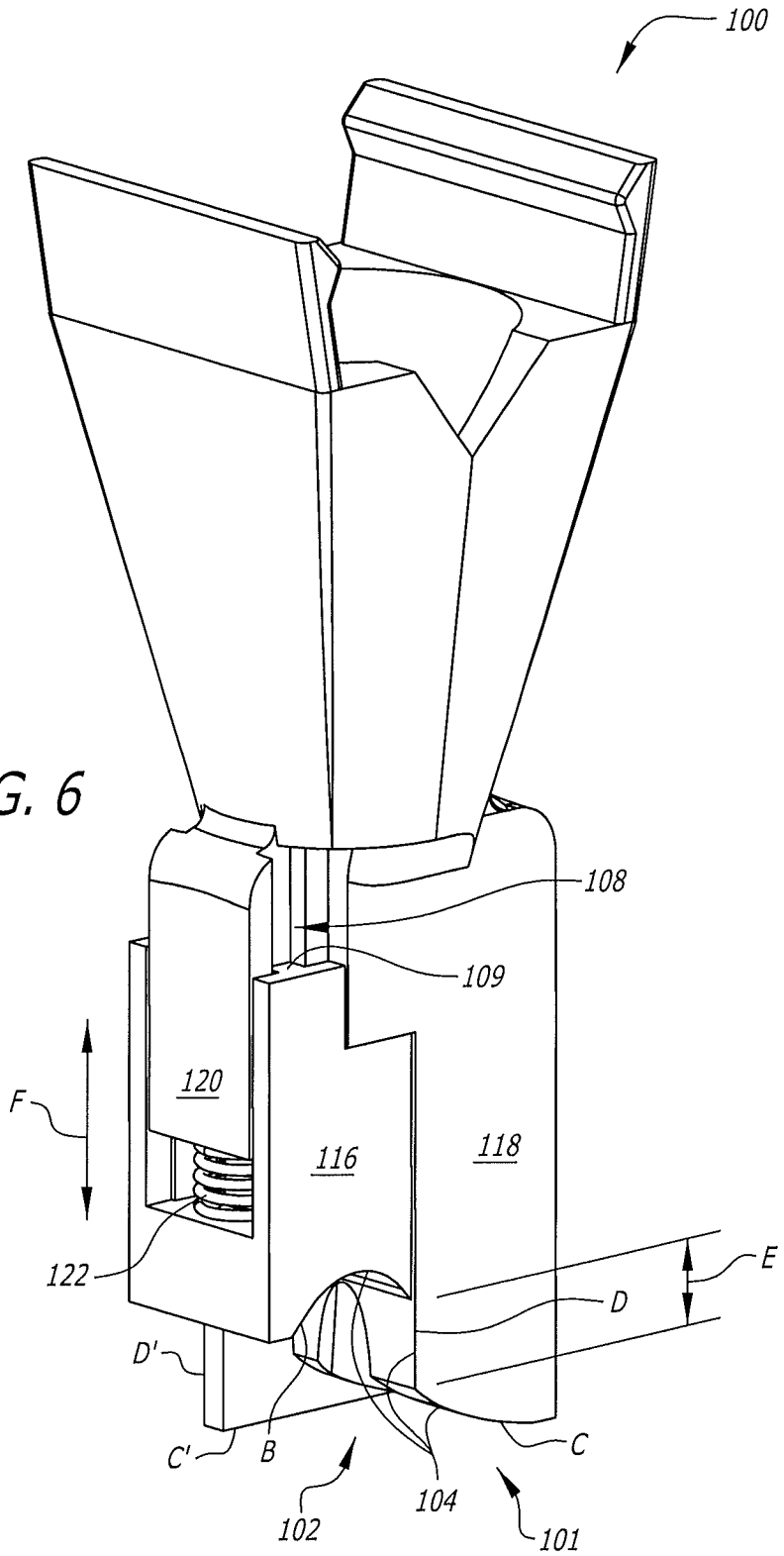
Figure 7:
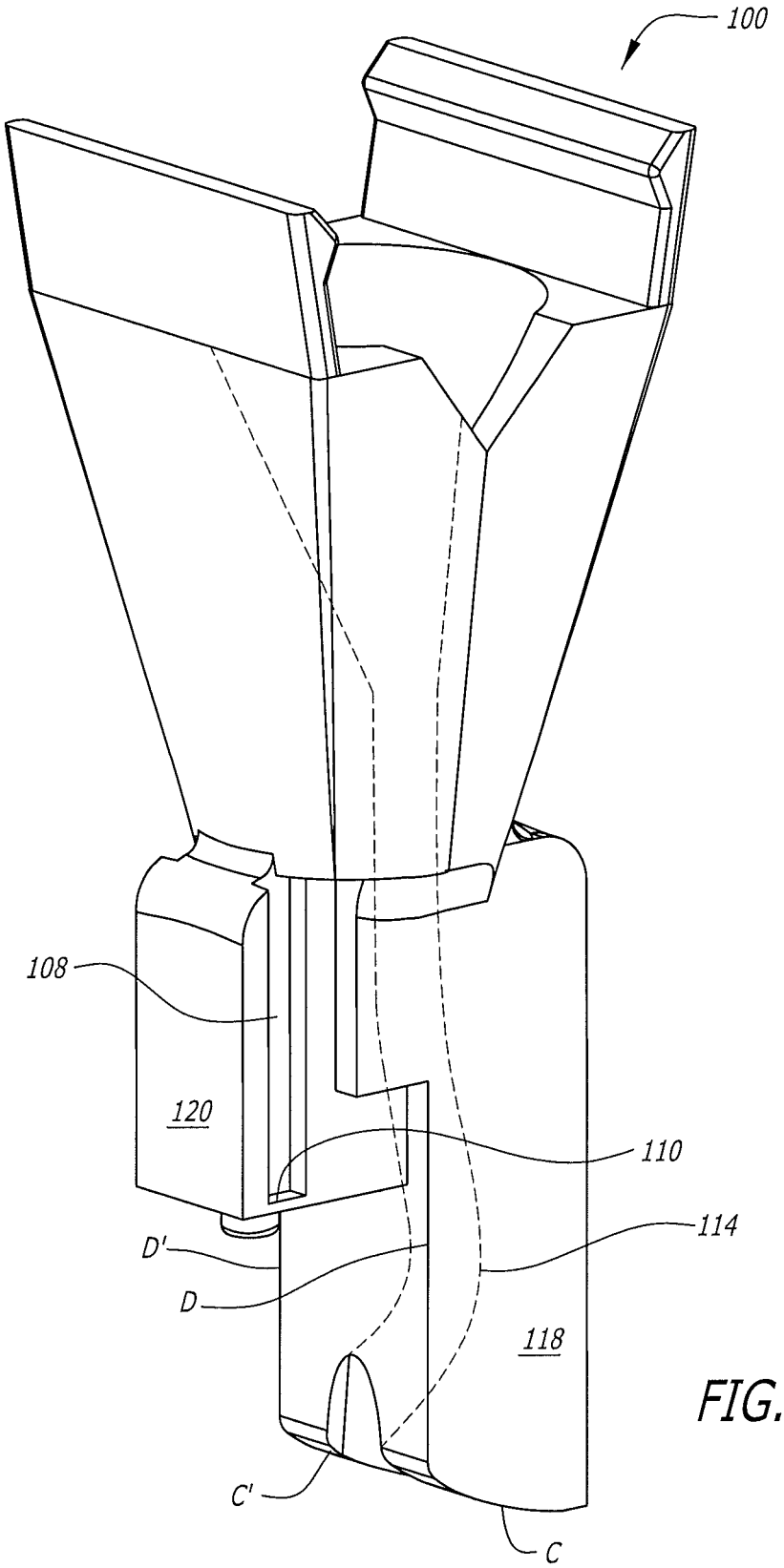
Figure 8:
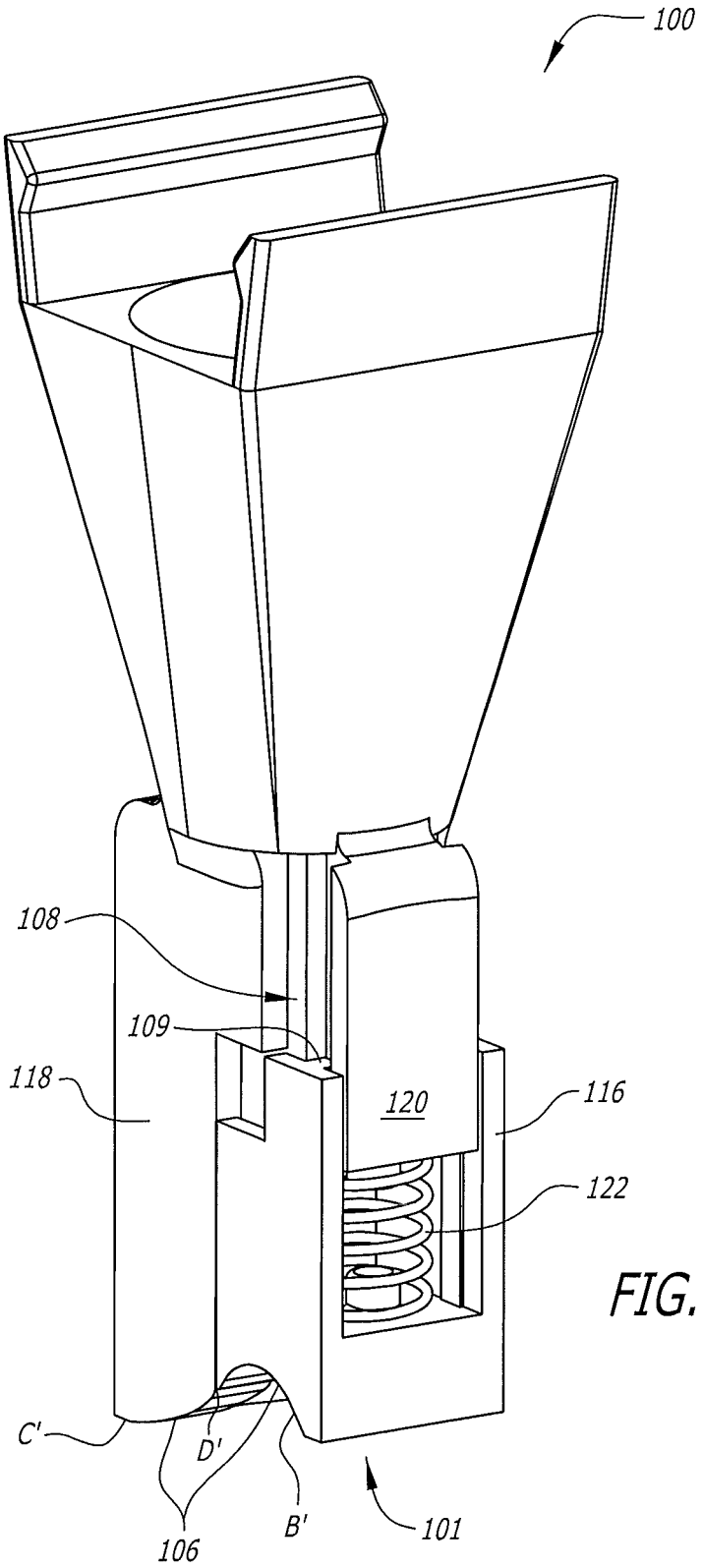

Referring generally to FIGS. 1-4, 6, 8, and 10, and particularly to e.g. FIG. 7, apparatus 100 also comprises substance delivery channel 114, first component 116 comprising portion B of first edge 104 of outlet end 101 and portion B' of second edge 106 of outlet end 101. Second component 118 comprises portion C of first edge 104 and portion C' of second edge 106. Second component 118 is not movable relative to substance delivery channel 114. The preceding subject matter of this paragraph is in accordance with example 22 of the present disclosure, and example 22 includes the subject matter of any of examples 2-21, above.

Substance delivery channel is a passage which conducts substance 200 from a supply (not shown) to outlet end 101. As depicted in FIG. 7, substance delivery channel 114 extends entirely through apparatus 100, particularly component 118. It would be possible to form substance delivery channel 114 as a blind hole, for example housing a supply of substance 200, such as a cartridge.

Referring generally to FIGS. 1, 2, 4, 6, 8, and 10, and particularly to e.g. FIGS. 2 and 3, second component 118 of the apparatus 100 also comprises portion D of first edge 104 of outlet end 101 and portion D' of second edge 106 of outlet end 101. First component 116 is movably coupled to second component 118. The preceding subject matter of this paragraph is in accordance with example 23 of the present disclosure, and example 23 includes the subject matter of example 22, above.

Movably coupling first component 116 to second component 118 enables apparatus 100 to comply with variations in A while dispensing substance 100 (FIG. 5) and moving along progression path 220. This occurs as second component 118 contacts layer 228 of geometric feature 204, while first component 116 contacts first layer 226.

Referring generally to FIGS. 1, 2, 11A, and 11B, and particularly to e.g. FIGS. 3, 4, 6, 8, and 10, apparatus 100 also comprises reaction block 120 coupled to second component 118, and means 122 for biasing first component 116 away from reaction block 120. The preceding subject matter of this paragraph is in accordance with example 24 of the present disclosure, and example 24 includes the subject matter of example 23, above.

With particular reference to FIG. 2, with apparatus 100 held firmly against layer 228 of geometric feature 204, means 122 biases first component 116 firmly against first layer 226, thereby constraining substance 200 to form bead 202 as intended, and not for example to escape the confines of outlet end 101 (FIG. 3). Escaping the confines of outlet end 101 laterally would cause an undesired thin skin of substance 200 to be deposited on first layer 226 of geometric feature 204.

Referring generally to FIGS. 1, 4, 6, 8, 10, 11A, and 11B, and particularly to e.g. FIGS. 2 and 3, apparatus 100 also comprises guide member 108 coupled to second component 118. The preceding subject matter of this paragraph is in accordance with example 25 of the present disclosure, and example 25 includes the subject matter of any of examples 23 or 24, above.

Guide member 108 may comprise a groove, a land interfitting with a groove, or a combination of these. These groove(s) and/or land(s) interfit with complementing groove(s) and/or land(s) in first component 116, thereby constraining first component 116 to translate along axis F when accommodating variations in dimension A as apparatus 100 is moved along progression path 220.

Referring generally to FIGS. 1, 4, 6, 8, 10, 11A, and 11B, and particularly to e.g. FIGS. 2 and 3, apparatus 100 further comprises guided member 109 coupled to first component 116. Guided member 109 is translatably coupled with guide member 108. The preceding subject matter of this paragraph is in accordance with example 26 of the present disclosure, and example 26 includes the subject matter of example 25, above.

Guided member 109, comprising a groove, a land interfitting with a groove, or a combination of these, provides the structure complementing guide member 108, necessary to constrain first component 116 to translate along axis F.

Referring generally to FIGS. 1, 4, 6, 8, and 10 and particularly to e.g. FIG. 7, apparatus 100 also comprises means 110 for limiting translation of first component 116 relative to second component 118. The preceding subject matter of this paragraph is in accordance with example 27 of the present disclosure, and example 27 includes the subject matter of any of examples 23-26, above.

Means 110 in the example of FIG. 7 is a ledge serving as a stop which effects retention of first component 116 on second component 118, thereby preventing unintended separation of first and second components 116, 118, and potential loss of first component 116. A corresponding stop at an opposed limit of translation of first component 116 is provided by the upper portion of apparatus 100.

Referring generally to FIGS. 1-4, 6, 8, and 10, and particularly to e.g. FIGS. 9A, 9B, 11A, 11B, 13A, 13B, 15A, 15B, 16A, and 16B, portion B of first edge 104 of outlet end 101 of apparatus 100 is identical to portion B' of second edge 106 of outlet end 101. The preceding subject matter of this paragraph is in accordance with example 28 of the present disclosure, and example 28 includes the subject matter of example 2, above.

When portions B and B' are identical, corresponding portions of bead 202 (FIG. 2) will be the same regardless of a direction of travel of apparatus 100 along progression path 220.

Referring generally to FIGS. 1-4, 6, 8, and 10, and particularly to e.g. FIGS. 12A, 12B, 14A, and 14B, portion B of first edge 104 of outlet end 101 of apparatus 100 is different from portion B' of second edge 106 of outlet end 101. The preceding subject matter of this paragraph is in accordance with example 29 of the present disclosure, and example 29 includes the subject matter of example 2, above.

When portions B and B' are different, beads 202 differing at their upper extremities (as illustrated in FIG. 5), e.g., at first curvature 222, are formed by apparatus 100, depending on the direction of travel of apparatus 100 along progression path 220.

Referring generally to FIGS. 1-4, 6-8, and 10, and particularly to e.g. FIGS. 12A, 12B, 14A, 14B, 16A, and 16B, portion C of first edge 104 of outlet end 101 of apparatus 100 is different from portion C' of second edge 106 of outlet end 101. The preceding subject matter of this paragraph is in accordance with example 30 of the present disclosure, and example 30 includes the subject matter of any of examples 2, 28, or 29, above.

When portions C and C' are different, beads 202 differing in shape at their lower extremities (as illustrated in FIG. 5), e.g., at second curvature 224, are formed by apparatus 100, depending on the direction of travel of apparatus 100 along progression path 220.

In addition when portions B and B' of first edge (104) are different and/or portions C and C' or second edge (106) are different, a vision system may be used to monitor the flow of sealant at either first edge (104) or second edge (106), depending on the direction of travel.

Referring generally to FIGS. 1-4, 6-8, and 10, and particularly to e.g. FIGS. 9A, 9B, 11A, 11B, 13A, 13B, 15A, and 15B, portion C of first edge 104 of outlet end 101 of apparatus 100 is identical to portion C' of second edge 106 of outlet end 101. The preceding subject matter of this paragraph is in accordance with example 31 of the present disclosure, and example 31 includes the subject matter of any of examples 2, 28, or 29, above.

When portions C and C' are identical, beads 202 identical at their lower extremities (as illustrated in FIG. 5), e.g., at second curvature 224, are formed by apparatus 100, regardless of the direction of travel of apparatus 100 along progression path 220.

Referring generally to FIGS. 1, 3, 4, 6, 7, and 10, and particularly to e.g. FIGS. 11A and 11B, portion D of edge 104 of outlet end 101 of apparatus 100 has length L variable from value $V_1$ to value $V_2$, and portion D' of second edge 106 of outlet end 101 has length L' variable from value $V_3$ to value $V_4$. $V_2$ is greater than $V_1$, and $V_4$ is greater than $V_3$. The preceding subject matter of this paragraph is in accordance with example 32 of the present disclosure, and example 32 includes the subject matter of any of examples 2-31, above.

In FIGS. 11A and 11B, value $V_1$ is shown as $L_1$; value $V_2$ is shown as $L_2$; value $V_3$ is shown as $L_1'$; and value $V_4$ is shown as $L_2'$. Relationships of variable values of lengths L and L' enable apparatus 100 to accommodate variations of dimension A of first layer 226 (FIG. 2) by translating along axis F, without changing profile characteristics of bead 202 at its extremities (e.g., at first and second curvatures 222, 224 (FIG. 5)).

Continuing to refer generally to FIGS. 1, 2, 4, 6, 7, and 10, and particularly to e.g. FIG. 3, value $V_1$ of length L of portion D of first edge 104 of outlet end 101 of apparatus 100 is zero. The preceding subject matter of this paragraph is in accordance with example 33 of the present disclosure, and example 33 includes the subject matter of example 32, above.

This enables bead 202 to transition immediately from portion B to portion C, without an intervening vertical (as shown in FIG. 3), straight portion D when dimension A of first layer 226 (FIG. 2) is at a minimal value. This configuration is achieved by locating means 110 appropriately on apparatus 100.

Still referring generally to FIGS. 1, 2, 4, 7, and 10, and particularly to e.g. FIG. 6, in apparatus 100, value $V_1$ of length L of portion D of first edge 104 of outlet end 101 of apparatus 100 is non-zero. The preceding subject matter of this paragraph is in accordance with example 3 4 of the present disclosure, and example 34 includes the subject matter of example 32, above.

This causes bead 202 always to include straight portion D to separate portion B from portion C when dimension A of first layer 226 (FIG. 2) is at a minimal value, when apparatus 100 moves along progression direction 220 such that edge 104 shapes bead 202. This configuration is achieved by locating means 110 appropriately on apparatus 100.

Now referring generally to FIGS. 1, 2, 4, 7, and 10, and particularly to e.g. FIG. 6, value $V_3$ of length L' of portion D' of second edge 106 of outlet end 101 of apparatus 100 is zero. The preceding subject matter of this paragraph is in accordance with example 35 of the present disclosure, and example 35 includes the subject matter of any of examples 32-34, above.

This enables bead 202 to transition immediately from portion B' to portion C', without an intervening vertical (as shown in FIG. 3), straight portion D' when dimension A of first layer 226 (FIG. 2) is at a minimal value, when apparatus 100 moves along progression direction 220 such that edge 106 shapes bead 202.

Figure 4:
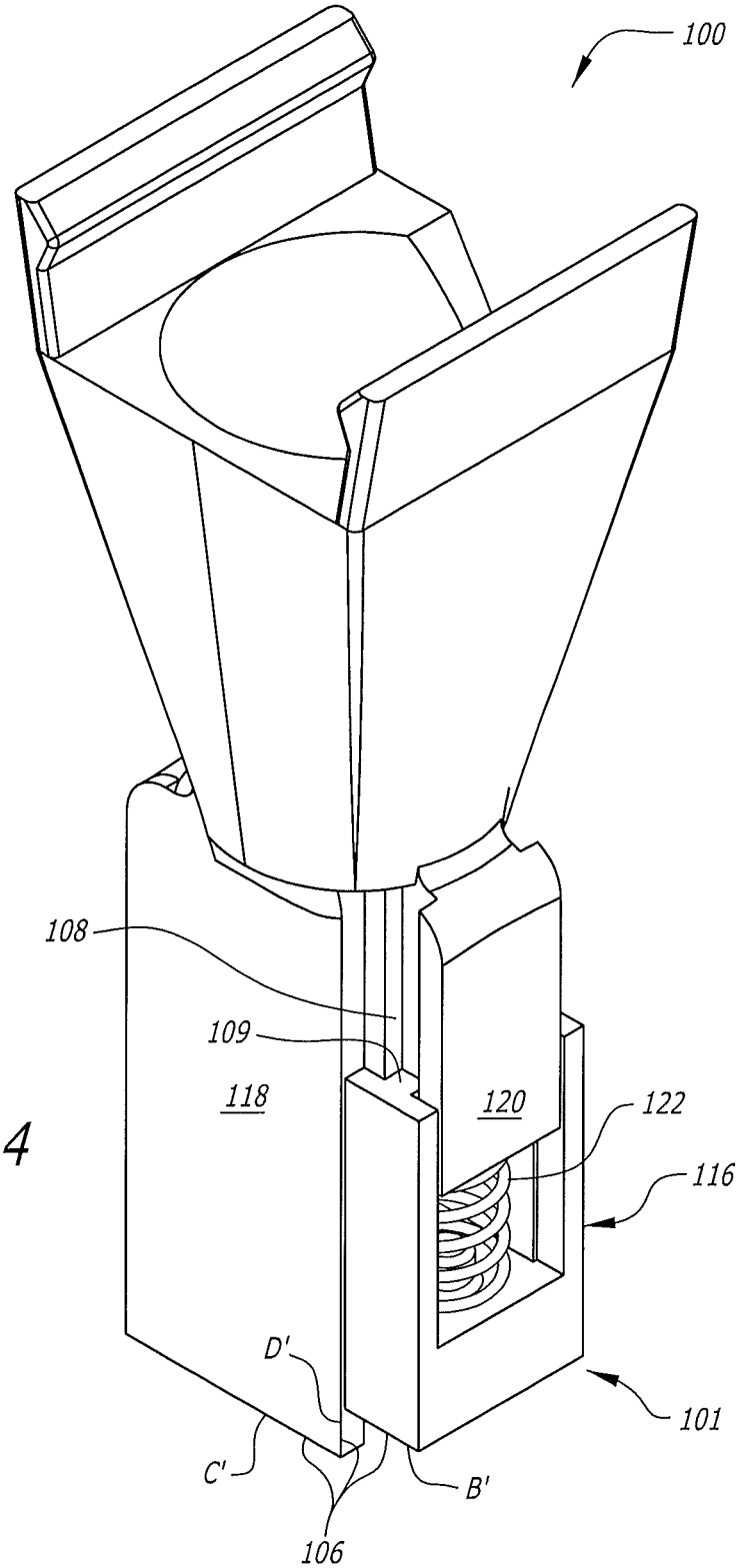

Now referring generally to FIG. 1 and particularly to e.g. FIGS. 4, 5, and 6, in apparatus 100, value $V_3$ of length L' of portion D' of second edge 106 of outlet end 101 of apparatus 100 is non-zero. The preceding subject matter of this paragraph is in accordance with example 36 of the present disclosure, and example 36 includes the subject matter of any of examples 32-34, above.

This causes bead 202 to always have a discernible portion D', such that stepless transition 218 (FIG. 5) is formed in bead 202.

Referring generally to FIG. 1, and particularly to e.g. FIGS. 2-4 and 6-16B, portion B of first edge 104 of outlet end 101 of apparatus 100 is not movable relative to portion B' of second edge 106 of outlet end 101 and portion C of first edge 104 is not movable relative to portion C' of second edge 106. The preceding subject matter of this paragraph is in accordance with example 37 of the present disclosure, and example 37 includes the subject matter of any of examples 2-36, above.

This enables apparatus 100 to be fabricated by forming first section 116 and second section 118 from a generally rigid material such as ABS plastic.

Referring generally to FIGS. 1, 2, 4 and 6-16B, and particularly to e.g. FIG. 3, portion D of first edge 104 of outlet end 101 of apparatus 100 and portion D' of second edge 106 of outlet end 101 are linear. The preceding subject matter of this paragraph is in accordance with example 38 of the present disclosure, and example 38 includes the subject matter of any of examples 2-37, above.

Linear portions D of first edge 104 and D' of second edge 106 enable apparatus 100 to accommodate variations in dimension A of first layer 226 (FIG. 2) by first component 116 sliding along second component 118 along axis F (FIG. 3) as apparatus 100 dispenses substance 200 to form bead 202.

Referring generally to FIGS. 1, 3, 4, 6-8 and 10, and particularly to e.g., to FIGS. 2 and 17, method 300 (block 302) of applying a substance 200 as bead 202 to geometric feature 204 extending along path 220, where geometric feature 204 includes dimension A that has a variation along path 220, is disclosed. Method 300 comprises providing apparatus 100 comprising outlet end 101 comprising first edge 104, second edge 106, and outlet opening 102 at least partially defined by first edge 104 and second edge 106. First edge 104 of outlet end 101 comprises portion B, portion C, and portion D between portion B and portion C, wherein portion D has length L. Second edge 106 of outlet end 101 comprises portion B', portion C', and portion D' between portion B' and portion C'. Portion D' has length L'. Method 300 further comprises establishing contact between at least a portion of geometric feature 204 and at least a portion of at least one of first edge 104 of outlet end 101 of apparatus 100 and second edge 106 of outlet end 101 of apparatus 100. Method 300 also comprises, responsive to moving apparatus 100 in a progression direction along path 220 while dispensing substance 200 from outlet opening 102 on at least the portion of geometric feature 204, varying length L of portion D of first edge 104 of outlet end 101 and length L' of portion D' of second edge 106 of outlet end 101 in direct proportion to the variation of dimension A of geometric feature 204 along path 220. The preceding subject matter of this paragraph is in accordance with example 39 of the present disclosure.

A method of depositing bead 202 onto geometric feature 204 while accommodating variation of dimension A of geometric feature 204 is thus achieved.

Still referring generally to FIGS. 1, 3, 4, 6-8 and 10, and particularly to e.g., to FIGS. 2 and 17, method 300 (block 304) further comprises translating portion B of first edge 104 of outlet end 101 of apparatus 100 and portion B' of second edge 106 of outlet end 101 relative to portion C of first edge 104 of outlet end 101 and portion C' of second edge 106 along axis F perpendicular to path 220 in direct proportion to the variation of dimension A of geometric feature 204 along path 220 as apparatus 100 is moved in the progression direction along path 220 while dispensing substance 200 from outlet opening 102. The preceding subject matter of this paragraph is in accordance with example 40 of the present disclosure, and example 40 includes the subject matter of example 39, above.

First layer 226 of geometric feature 204 (FIG. 2) is thereby covered to a consistent thickness by bead 202 despite variation of dimension A of geometric feature 204.

Continuing to refer generally to FIGS. 1, 3, 4, 6-8 and 10, and particularly to e.g., to FIGS. 2 and 17, method 300 (block 304) further comprises simultaneously forming first curvature 222 of bead 202, second curvature 224 of bead 202, and stepless transition 218 along bead 202 between first curvature 222 of bead 202 and second curvature 224 of bead 202. The preceding subject matter of this paragraph is in accordance with example 41 of the present disclosure, and example 41 includes the subject matter of any of examples 39 or 40, above.

First and second curvatures 222, 224, with stepless transition therebetween, can thus be expeditiously formed in bead 202 by moving apparatus 100 along path 220, without conscious effort by a person operating apparatus 100 to shape any of first or second curvatures 222, 224 or stepless transition 218.

Examples of the present disclosure may be described in the context of aircraft manufacturing and service method 1800 as shown in FIG. 18 and aircraft 1902 as shown in FIG. 19. During pre-production, illustrative method 1800 may include specification and design (block 1804) of aircraft 1902 and material procurement (block 1806). During production, component and subassembly manufacturing (block 1808) and system integration (block 1810) of aircraft 1902 may take place. Thereafter, aircraft 1902 may go through certification and delivery (block 1812) to be placed in service (block 1814). While in service, aircraft 1902 may be scheduled for routine maintenance and service (block 1816). Routine maintenance and service may include modification, reconfiguration, refurbishment, etc. of one or more systems of aircraft 1902.

Each of the processes of illustrative method 1800 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG.19, aircraft 1902 produced by illustrative method 1800 may include airframe 1918 with a plurality of high-level systems 1920 and interior 1922. Examples of high-level systems 1920 include one or more of propulsion system 1924, electrical system 1926, hydraulic system 1928, and environmental system 1930. Any number of other systems may be included. Although an aerospace example is shown, the principles disclosed herein may be applied to other industries, such as the automotive industry. Accordingly, in addition to aircraft 1902, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1800. For example, components or subassemblies corresponding to component and subassembly manufacturing (block 1808) may be fabricated or manufactured in a manner similar to components or subassemblies produced while aircraft 1902 is in service (block 1814). Also, one or more examples of the apparatus(es), method(s), or combination thereof may be utilized during production stages 1808 and 1810, for example, by substantially expediting assembly of or reducing the cost of aircraft 1902. Similarly, one or more examples of the apparatus or method realizations, or a combination thereof, may be utilized, for example and without limitation, while aircraft 1902 is in service (block 1814) and/or during maintenance and service (block 1816).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus(es) and method(s) disclosed herein in any combination, and all of such possibilities are intended to be within the spirit and scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples illustrated and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims. Accordingly, parenthetical reference numerals in the appended claims are presented for illustrative purposes only and are not intended to limit the scope of the claimed subject matter to the specific examples provided in the present disclosure.

What is claimed is:

1. A method of applying a substance as a bead to a geometric feature extending along a path, the geometric feature including a dimension A that has a variation along the path, the method comprising:

providing an apparatus comprising an outlet end comprising a first edge, a second edge, and an outlet opening at least partially defined by the first edge and the second edge, wherein the first edge and the second edge are reversibly extensible, wherein:

the first edge of the outlet end comprises a portion B, a portion C, and a portion D between the portion B and the portion C, wherein the portion D has a length L; and the second edge of the outlet end comprises a portion B', a portion C', and a portion D' between the portion B' and the portion C', wherein the portion D' has a length L';

establishing contact between at least a portion of the geometric feature and at least a portion of at least one of the first edge of the outlet end and the second edge of the outlet end;

moving the apparatus in a progression direction along the path while dispensing the substance from the outlet opening on at least the portion of the geometric feature, wherein the first edge or the second edge is located on a trailing edge of the apparatus as the apparatus moves along the path such that the trailing edge provides a shape to the bead on the geometric feature while passing over the bead on the geometric feature; and varying the length L of the portion D of the first edge of the outlet end and the length L' of the portion D' of the second edge of the outlet end in direct proportion to the variation of the dimension A of the geometric feature along the path.

2. The method of claim 1, further comprising translating the portion B of the first edge of the outlet end and the portion B' of the second edge of the outlet end relative to the portion C of the first edge of the outlet end and the portion C' of the second edge of the outlet end along an axis F perpendicular to the path in direct proportion to the variation of the dimension A of the geometric feature along the path as the apparatus is moved in the progression direction along the path while dispensing the substance from the outlet opening.

3. The method of claim 1, further comprising simultaneously forming a first curvature of the bead, a second curvature of the bead, and a stepless transition along the bead between the first curvature of the bead and the second curvature of the bead.

4. The method of claim 1, further comprising:

moving the portion B of the first edge relative to the portion C of the first edge; and moving the portion B' of the second edge relative to the portion C' of the second edge.

5. The method of claim 1, further comprising contacting and forming the shape of the bead with the portion B and the portion C of the first edge when the progression direction along the path is such that the first edge is the trailing edge.

6. The method of claim 1, further comprising contacting and forming the shape of the bead with the portion B' and the portion C' of the second edge when the progression direction along the path is such that the second edge is the trailing edge.

7. The method of claim 1, wherein:

the apparatus further comprises a first component, comprising the portion B of the first edge of the outlet end and the portion B' of the second edge of the outlet end; and the first component is made of a rigid material so that the portion B of the first edge and the portion B' of the second edge are invariable in shape.

8. The method of claim 7, wherein:

the apparatus further comprises a second component, comprising the portion C of the first edge of the outlet end and the portion C' of the second edge of the outlet end; and the second component is made of a rigid material so that the portion C and the portion C' are invariable in shape.

9. The method of claim 8, further comprising moving the first component relative to the second component.

10. The method of claim 8, further comprising conducting the substance through a substance delivery channel of the apparatus, wherein the substance delivery channel is located at least partially in the second component.

11. The method of claim 8, wherein:

the second component further comprises the portion D of the first edge of the outlet end and the portion D' of the second edge of the outlet end; and the first component is movably coupled to the second component.

12. The method of claim 8, further comprising biasing the first component away from a reaction block that is coupled to the second component.

13. The method of claim 8, wherein the apparatus further comprises a guide member coupled to the second component.

14. The method of claim 13, wherein:

the apparatus further comprises a guided member, coupled to the first component; and the guided member is translatably coupled with the guide member.

15. The method of claim 8, further comprising limiting translation of the first component relative to the second component.

16. The method of claim 1, wherein the portion B of the first edge of the outlet end is identical to the portion B' of the second edge of the outlet end.

17. The method of claim 1, wherein the portion B of the first edge of the outlet end is different from the portion B' of the second edge of the outlet end.

18. The method of claim 1, wherein the portion C of the first edge of the outlet end is different from the portion C' of the second edge of the outlet end.

19. The method of claim 1, wherein the portion C of the first edge of the outlet end is identical to the portion C' of the second edge of the outlet end.

20. The method of claim 1, wherein:

the length L of the portion D of the first edge of the outlet end is variable from a value $V_1$ to a value $V_2$;

the length L' of the portion D' of the second edge of the outlet end is variable from a value $V_3$ to a value $V_4$;

$V_2$ is greater than $V_1$; and $V_4$ is greater than $V_3$.

* * * * *